United States Patent [19]

Burda

[11] Patent Number: 4,793,561

[45] Date of Patent: Dec. 27, 1988

[54] SPEED-RESPONSIVE REVERSING HYDRAULIC DRIVE FOR ROTARY SHREDDER

[75] Inventor: Dan S. Burda, Carrollton, Tex.

[73] Assignee: MAC Corporation of America, Grand Prairie, Tex.

[21] Appl. No.: 381,432

[22] Filed: May 24, 1982

[51] Int. Cl.[4] ..... B02C 25/00

[52] U.S. Cl. ..... 241/36; 241/101.2; 241/236

[58] Field of Search ..... 241/33–37, 241/30, 32, 227, 236, 101.2

[56] References Cited

U.S. PATENT DOCUMENTS 3,868,062 2/1975 Cunningham et al. .

4,034,918 7/1977 Culbertson et al. .

4,452,400 6/1984 Williams ..... 241/236 X

*Primary Examiner*—Mark Rosenbaum

*Attorney, Agent, or Firm*—Klarquist, Sparkman, Campbell, Leigh & Whinston

[57] ABSTRACT

A hydraulic drive for a rotary shredder includes a rotation-actuated electric reversing control. Such control includes a rotation sensor positioned on one of the rotational elements of the drive: one of the cutter shafts, the hydraulic drive motor shaft or the hydraulic pump motor shaft. An RPM monitor circuit receives a signal from the rotation sensor and measures rotational speed to determine existence of a stoppage or slowing of the shaft corresponding to a jamming condition. This circuit monitors shaft speed over discrete time intervals and discriminates between momentary jamming conditions by determining the duration of low shaft speed conditions. The circuit transmits a jam signal to a reversal actuator circuit upon detection of a subnormal shaft speed persisting longer than the predetermined time interval. The reversal actuator circuit includes a timer and reverse and forward solenoids on a flow-reversing valve for briefly reversing fluid flow to the hydraulic motor when a jam signal is received. Monitoring rotation at the pump motor enables the hydraulic fluid circuit, including a pressure relief valve, and the pump motor to filter out brief changes in rotation due to momentary jamming conditions and thereby aid in discriminating between true and momentary jamming conditions.

8 Claims, 2 Drawing Sheets

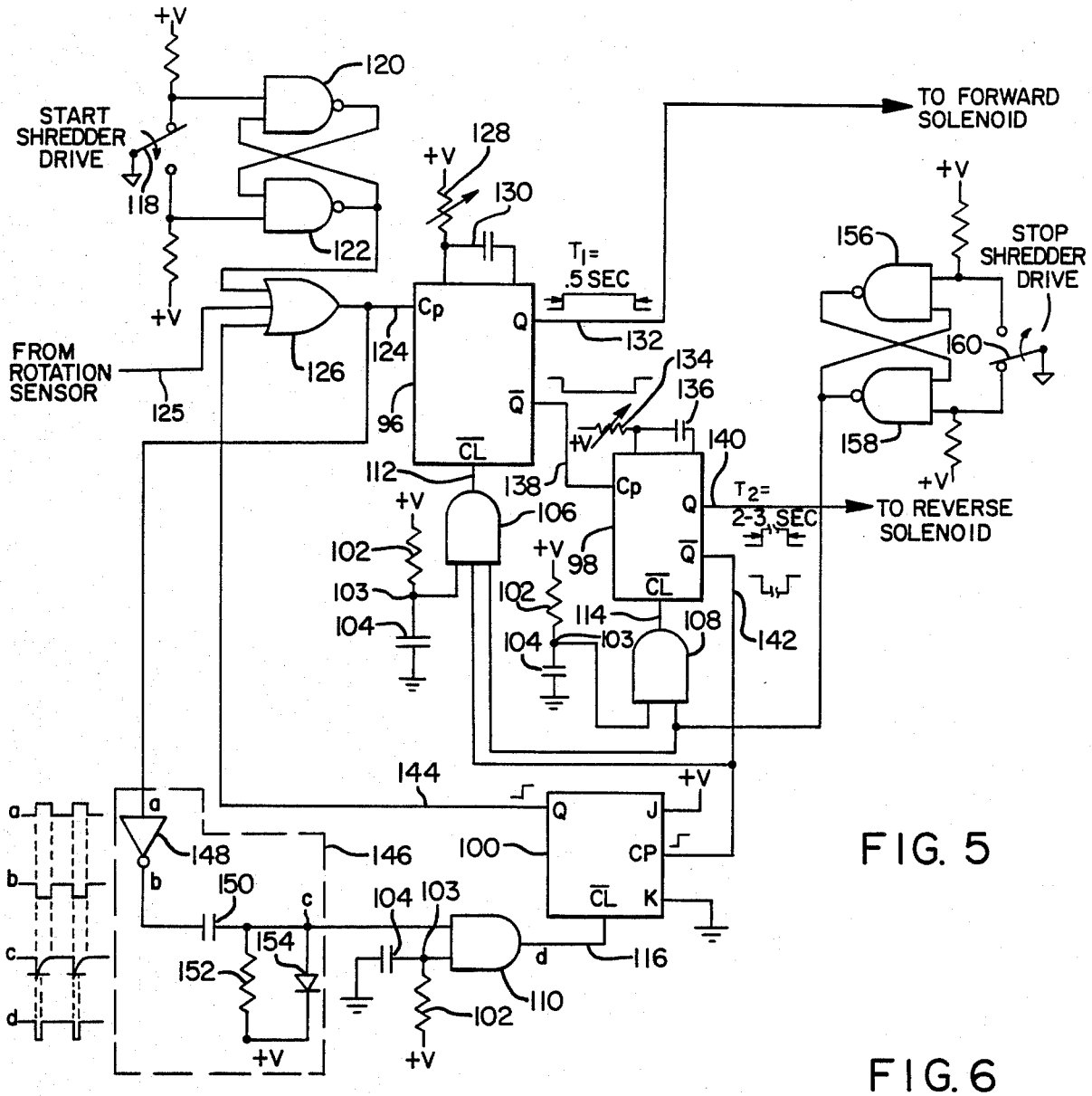
FIG. 5
FIG. 6
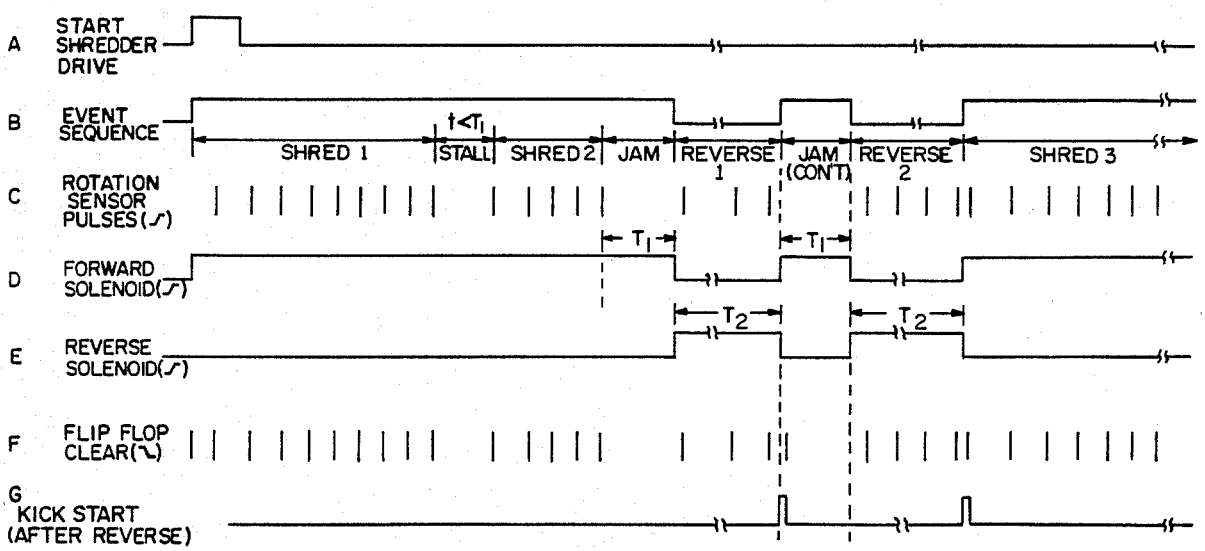

SPEED-RESPONSIVE REVERSING HYDRAULIC DRIVE FOR ROTARY SHREDDER

BACKGROUND OF THE INVENTION

This invention relates generally to shear-type shredders and, more particularly, to automatically reversible hydraulic drive arrangements for such shredders.

Hydraulically driven, shear-type shredders are disclosed in U.S. Pat. No. 3,868,062 to Cunningham, et al. and U.S. Pat. No. 4,034,918 to Culbertson, et al. Prior to the drive arrangements disclosed in those patents, a shear-type shredder was typically driven by an electric motor through a high speed-reduction gear train. Any jamming condition occurring in the shredder was transmitted directly to the motor through the gear train. The motor was provided with electric current-sensing and motor-reversing circuitry to detect a jamming condition in the shredder and reverse the electric motor briefly to clear the jam. The arrangement was satisfactory for small shredders having a maximum rating of approximately 20–30 horsepower. By comparison, the high torques required by larger shredders, coupled with frequent jamming and reversing sequences, often caused the electric motors to overheat and burn out.

Accordingly, it was proposed that such shredders be driven hydraulically by interposing a hydraulic pump, motor, and fluid circuit with pressure relief valves between the shredder mechanism and the electric motor. The electric motor would then drive the hydraulic pump. Persons involved in shear-type shredder design believed that this arrangement would effectively isolate the electric motor from excessive torque loads due to jamming conditions in the shredder, and thereby prevent burnout. The earliest hydraulic shredder drive designs employed hydraulic sequencing valves in their hydraulic circuits which both detected jamming conditions upon an increase in hydraulic pressure and briefly actuated a flow-reversing valve in the circuit to reverse the hydraulic motor and thereby clear the jamming condition. This design operated erratically due to both variations in fluid viscosity with temperature and resultant difficulties in determining a consistent reversal pressure threshold.

To correct these problems, as well as others, the aforementioned patents proposed drive arrangements which continued to both sense jamming conditions and actuate a flow reversal means in the hydraulic circuit, but did so with electrical means rather than with hydraulic means. More specifically, those designs employed pressure-actuated electric switches, electrically operated pneumatic timers and control relays, and electric reversal solenoids. By electrically signaling overpressures in the hydraulic circuit and electrically reversing the hydraulic shredder motor, the reversal cycle was no longer subject to hydraulic fluid temperature and viscosity variations.

These electric-hydraulic reversing circuits, however, introduced several new problems. One problem was the initiation of unintended reversals when the shredder jammed momentarily on tough or excess material and then cut through the material. Another problem was frequent failure of hydraulic pressure-actuated switches.

Both problems are characterized by momentary pressure spiking in the hydraulic circuit. Due to the relative incompressibility of the fluid, a momentary jamming condition in the shredder causes the pressure in the hydraulic circuit to rise very quickly. When the shredder mechanism breaks through the material being shredded, hydraulic pressure suddenly decreases. This momentary rise and fall in hydraulic pressure forms a pressure spike. Such a momentary jamming condition often causes pressure spikes of sufficient magnitude to actuate the hydraulic pressure switch and thereby initiate a reversing cycle. Even though a true jamming condition had not occurred and reversal subsequently proves unnecessary, the reversing sequence, once initiated, would continue until completion.

Each reversal cycle is about one to three seconds duration. In shredding tough materials, such as truck tires or sheet aluminum, true jamming conditions can occur up to several times a minute but usually occur less often. However, momentary jamming conditions occur more frequently, typically a half dozen or more times a minute. Under these conditions, a significant portion of available shredding time can be lost.

This problem is especially significant in very large, for example, 300–600 horsepower shear-type shredders, not only because of the greater inefficiency of unnecessary reversals, but because such large machines are also more prone to pressure spikes. Small shredder drives use high speed electric or hydraulic motors with reduction gear trains which provide sufficient angular momentum to help cut through tough material and thereby help overcome momentary jamming conditions without initiating unintended reversals. However, very large shredders use high torque, low speed radial piston motors with little or no speed reduction gearing. Hence, they rely much less on angular momentum to assist in overcoming momentary jamming conditions. minimal angular momentum enables the large shredders to reverse quickly without damage to the drive arrangement, but it makes such machines more prone to pressure spiking and, therefore, unnecessary actuation of reversal.

One proposed solution to this problem employs a second timer in the electrical reversing control circuit between the pressure switch and the reversal actuation and timing circuitry. This timer is started when the pressure switch is actuated by either a momentary or a true jamming condition. Upon completion of its timing interval, about one-half second, this timer starts the reversal cycle if the pressure switch is still actuated, indicating a true jamming condition. If the pressure switch is no longer actuated, indicating a momentary jamming condition which has been relieved, the reversal cycle is not started and the shredder continues shredding uninterrupted.

While this approach reduces the amount of unnecessary reversing, it does not prevent overuse of the pressure switches, which causes them to wear out sooner than desired. It has, therefore, been proposed to modify the hydraulic fluid circuit to include fluid accumulators and flow constrictors to filter out pressure spikes due to momentary jamming conditions.

Some improvement in operation was noted, but not enough to enable elimination of the second timer or to prevent premature failure of the pressure switch. In addition, the second timer and added hydraulic components are expensive and unduly increase the complexity of the drive arrangement. It would be preferable to avoid such complexity because of the dirty environment in which such shredders are used and the difficulty of maintaining and adjusting both the hydraulic and electrical control circuits by servicemen without special training. It would also be desirable to avoid relying on failure-prone components, such as pressure-actuated electrical switches.

Accordingly, there remains a need for an improved automatically reversible hydraulic drive arrangement for shear-type shredders.

SUMMARY OF THE INVENTION

A primary object of the invention is to reliably actuate reversal of hydraulically driven shear-type shredders when a true jamming condition occurs but not otherwise.

A second object is to sense jamming conditions in the shredder without reliance on a fluid pressure-actuated electrical switch.

A third object is to simplify the hydraulic fuild circuitry in hydraulic drive arrangements for such shredders.

Another important object is to minimize the cost and complexity of such circuitry and, accordingly, the skill level required to maintain drive arrangements as aforementioned.

The invention meets the foregoing objects by removing the function of sensing a jamming condition from the hydraulic fluid circuit altogether while continuing to effect reversal within the hydraulic circuit. This jam-sensing function is instead accomplished by measuring the speed of a mechanical drive element of the shredder, such as the rotating output shaft of the electric motor or other prime mover driving the hydraulic pump, the output shaft of the hydraulic motor, or any other rotational element of the shredder drive train between the hydraulic motor and the cutter shafts, or even the cutter shafts themselves.

Hydraulic pressure switches respond instantaneously to fluid pressure changes and, therefore, to pressure spikes due to momentary jamming conditions. In contrast, measuring speed changes, such as variations in rotation of a shaft during fixed time intervals, averages out brief speed changes occurring during such time intervals. This capability enables the jam sensing means to disregard instantaneous speed changes, including many due to momentary jamming conditions, while remaining fully responsive to true jamming conditions.

The electric motor-driven hydraulic pump is operatively connected to the cutter shafts of the shredder through the hydraulic fluid circuit for the hydraulic motor. Therefore, an increase in load on the shredder correspondingly decreases the speed of rotation of the cutter shafts and of all connected rotational components of the drive train all the way back to the electric motor. A true jamming condition is typically characterized by a cessation of rotation of the cutter and hydraulic motor shafts and a slowing of the electric motor shaft. A momentary jamming condition briefly stops or slows the cutter and hydraulic motor shafts but, because of the filtering effects of the hydraulic fluid circuit, including a pressure relief valve, and the momentum of the electric motor, does not usually perceptibly slow the electric motor shaft.

In accordance with these principles, the invention is a hydraulic drive arrangement for a shear-type shredder, which includes an electrically operable reversing control means comprising a jam sensing means operatively connected externally of the hydraulic fluid circuit to a mechanical element of the shredder drive for sensing jamming conditions in the shredder, and actuation means for actuating a flow-reversing means for reversing the flow in the fluid circuit. Reversal of the direction of fluid flow reverses the shredder and thereby clears the jamming condition. The drive arrangement preferably includes a discriminator means for damping or filtering out the effects of momentary jamming conditions before they can cause the jam sensing means to detect a jamming condition and transmit a jam signal to the actuation means. This function can be provided electrically, in the jam sensing means, or mechanically, in fluid circuit and pumping means by positioning the jam sensing means, for example, at the output shaft of the electric motor.

The jam sensing means preferably comprises a rotation sensor means and means responsive thereto for measuring rotational speed or revolutions per minute (RPM). The rotation sensor means can be located proximtate to the drive train between the electric motor driving the hydraulic fluid pumping means or to the drive train between the reversible hydraulic motor means and the cutter shafts. The jam sensing means continually monitors shaft rotation and provides a corresponding signal to the measuring means or RPM monitor. Upon detection of cessation or slowing of rotation below a predetermined speed, the measuring means produces a jam signal to the actuation means. The measuring means monitors shaft position over intervals of time and thereby provides the aforementioned filtering function.

The actuation means provides electrical control signals including a timed reversing signal to the flow-reversing means, which can be solenoid operated. It can also include a time delay means actuated by the jam sensing means to delay briefly production of a reversing signal by the actuator means until a true jamming condition is confirmed. The reversing signal actuates the flow-reversing means whenever the jam sensing means output signal indicates a continued slowing of shaft rotation below a minimum threshold speed after a predetermined time delay has expired. The actuation means can further include lockout means responsive to the reversing signal for temporarily blocking operation of the jam sensing means or generation of a forward shredding signal, or both, during shredding.

The foregoing and other objects, features, and advantages of the present invention will become more apparent from the following detailed description, which proceeds with reference to the accompanying drawings.

BRIEF DESCRIPTION OF DRAWINGS

FIG. 5 is an electrical circuit diagram of a second example of the electrical reversing control portion of FIGS. 1 and 2.

FIG. 6 is a logic timing diagram associated with the electrical control circuit of FIG. 5.

DETAILED DESCRIPTION OF PREFERRED EMBODIMENT

Overall Arrangement

Figure 2:
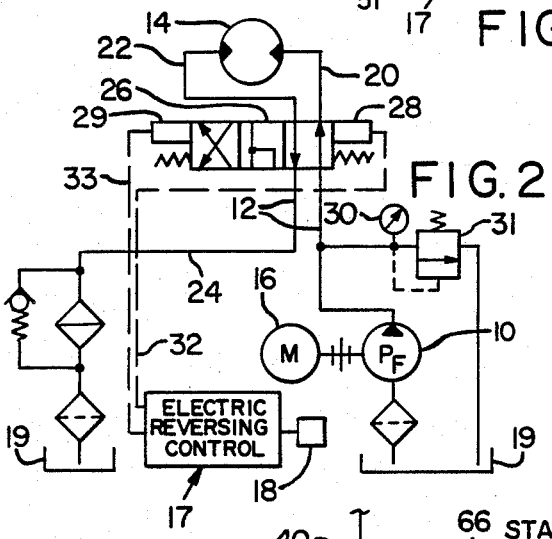
FIG. 2 is a fluid circuit diagram of the hydraulic drive portion of FIG. 1.
Figure 4:
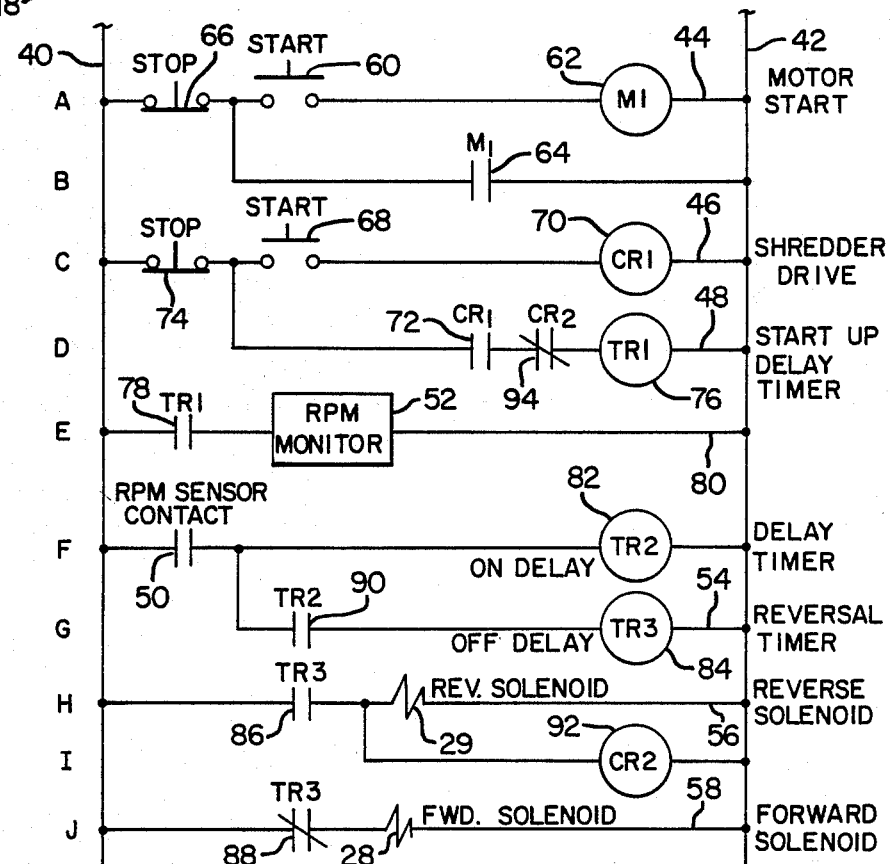
FIG. 4 is an electrical circuit diagram of a first example of the electrical reversing control portion of FIGS. 1 and 2.

In general, the overall structure of a typical shear-type shredder incorporating the present invention is like that of U.S. Pat. No. 4,034,918, which is incorporated by reference herein. FIGS. 2 and 4 hereof correspond roughly to the left side of FIG. 5 and to FIG. 6 of such patent, respectively, with the differences forming the present invention described below. This invention can also be readily adapted to a shredder using the hydraulic circuit of FIG. 4 of U.S. Pat. No. 4,034,918 or to the shredder drive arrangement disclosed in U.S. Pat. No. 3,868,062. However, the following description discloses the presently preferred and best modes of the invention.

Figure 1:
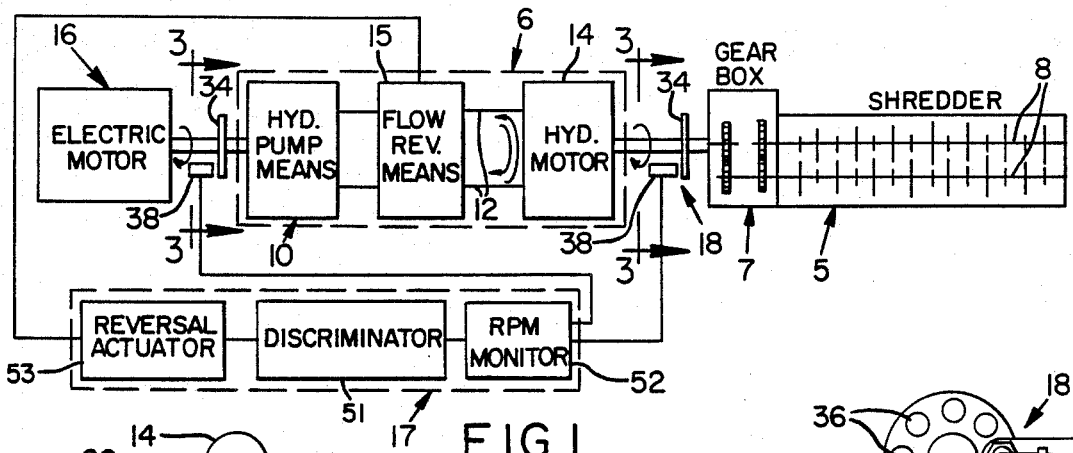
FIG. 1 is a functional block diagram of a hydraulically-driven, shear-type shredder incorporating the present invention.

Referring to FIG. 1, the shear-type shredding mechanism 5 is driven by a reversible hydraulic drive means 6 through a gear drive train 7 arranged to counterrotate cutter shafts 8 of the shredder at different speeds, for example, 40 and 60 RPM. The hydraulic drive means includes a hydraulic pump 10 which pumps fluid through a fluid circuit 12 to a reversible, high-torque, low-speed hydraulic motor 14. A flow-reversing means 15 is positioned in circuit 12 for reversing fluid flow to reverse the shredder. An electric motor 16 continuously drives pump 10 in one rotational direction during operation. An electrical reversing control means 17 controls flow-reversing means 15 during operation. It includes a rotation sensor 18 positioned as shown to monitor the speed of shaft rotation of either hydraulic motor 14 or electric motor 16. Sensor 18 can alternatively be positioned at any other rotating element of the drive arrangement, such as one of the gears in gear train 7 or one of cutter shafts 8. The control means senses a slowing of shaft rotation, discriminates between reductions in shaft speed due to momentary and true jamming conditions in the shredder mechanism and responds solely to the latter condition to actuate the flow-reversing means, as described in further detail hereinafter.

Hydraulic Drive Arrangement

Referring to FIG. 2, hydraulic pump 10 is a fixed displacement pump which draws hydraulic pressure fluid from a tank 19 and pumps it through hydraulic circuit 12. Circuit 12 includes a fluid supply line 20 leading to what is normally the intake side of the hydraulic motor 14 and a fluid return line 22 from such motor to a return line 24 leading to tank 19. The flow-reversing means comprises a three-position, open-center, spring-centered four-way valve 26, actuable by a forward solenoid 28 to deliver fluid via line 20 to drive hydraulic motor 14 in the forward direction and by a reverse solenoid 29 to deliver fluid via line 22 and thereby reverse the fluid flow and, hence, the direction of motor 14. As those skilled in the art will understand, valve 26 is shown symbolically. It is preferably a master-slave or pilot-operated valve with a choke block or adjustable orifice for controlling the speed at which the slave valve is shifted.

Hydraulic motor circuit 12 also includes a pressure gauge 30 and a high pressure relief valve 31 to bleed fluid from the high pressure line 20 of the fluid circuit into tank 19 whenever the hydraulic circuit pressure exceeds a predetermined upper limit. That limit is set at a pressure, for example, 2800 p.s.i., somewhat above the pressures prevailing during shredding, around 2500 p.s.i. This setting is below the setting conventionally used to protect the fluid circuit elements of the shredder, for example, about 3200 p.s.i. So set, the relief valve can aid in discriminating between true and momentary jamming conditions by relieving and thereby attenuating fluid pressure spikes due to the latter condition. Sensing changes in rotation speed at the electric motor shaft takes advantage of this capability.

Electric reversing control means 17 is operatively coupled to the rotational output shaft of either hydraulic motor 14 or electric motor 16, or any other rotational element of the shredder drive train, to detect a slowing of rotation due to changes in load on the cutter shafts. During shredding, such changes are transmitted through gear train 7 and the shaft of hydraulic motor 14. These changes in load are transmitted further through the hydraulic motor, fluid circuit and pump to electric motor 16 for detection at the electric motor shaft. Control means 17 transmits electrical control current signals through either control line 32 or line 33 to alternatively enregize either valve solenoid 28 or solenoid 29 for maintaining the flow-reversing valve 26 in either a forward or reverse position to operate the hydraulic motor 14 in either a "forward" direction for shredding or "reverse" direction for clearing a jam by driving the interconnected cutter shafts 8 in corresponding directions. Control means 17 automatically actuates a reversal only when the slowing or cessation of shaft rotation indicates a true stoppage or jamming condition in the shredding mechanism, as next explained.

Rotation Sensor and RPM Monitor

Figure 3:
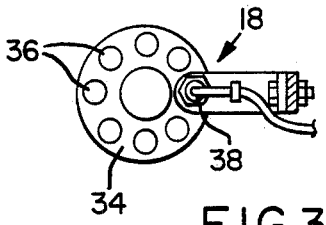
FIG. 3 is an enlarged vertical sectional view taken along lines 3—3 of FIG. 1 showing the rotation sensing apparatus located at the hydraulic motor output shaft.

Referring to FIGS. 1 and 3, rotation sensor 18 typically includes an annular disk 34 securely mounted to the periphery of the shaft of either hydraulic motor 14, electric motor 16 or any other rotatable element of the shredder drive train. On a face of disk 34 is a plurality (eight are shown in FIG. 3) of circular magnetic elements 36 which are angularly spaced equidistantly and positioned along equal radii near the outer edge of the disk. Aligned with and spaced from this annular array of disks is a stationary rotation sensor probe 38 secured to the shredder structure. As the shaft rotates, magnetic elements 36 produce a changing magnetic field proportional to the speed of rotation of the disk relative to the probe. Probe 38 includes a magnetic pickup coil that is responsive to each element 36 to produce an electric current pulse each time a magnetic element passes by. Thus, sensor probe 38 produces an output pulse train consisting of eight pulses per shaft revolution. Since the magnetic elements are uniformly spaced about the periphery of the disk, a given speed of shaft rotation corresponds to a single pulse train frequency with a constant duty factor. A change in shaft speed causes a proportional change in pulse train frequency.

The selection of the shaft to be monitored must be coordinated with the speed measuring capability of the rotation sensor. The electric motor shaft rotates typically at 1800 RPM and therefore requires a rotation sensor having sufficient bandwidth to track a minimum of 10,000 pulses per minute for an eight-element disk 34. The hydraulic motor shafts, on the other hand, rotate typically at 60 RPM or less, requiring a lower bandwidth rotation sensor. Increasing the number of magnetic elements increases the sensitivity of the rotation sensor so that very slow hydraulic motor or cutter shaft speeds can be detected in a shorter period of time.

Fewer magnetic elements can be used on the high speed shaft of the electric motor. As further described below, the shaft of electric motor 16 rotates in only one direction. Therefore, monitoring this shaft would eliminate the need for certain components in the control circuitry described in Example 1 below.

The pulse train signal produced by rotation sensor 18 is applied to an RPM monitor 52, the part of the reversing control means 17 which measures the speed of shaft rotation.

Responsive to the RPM monitor is an electrical discriminator element 51, including an adjustable time-interval based measuring circuit, which detects subnormal shaft speeds persisting longer than a preset time interval. Discriminator element 51 thereby detects true jamming conditions but not most momentary jamming conditions. When average shaft speed drops below a preset threshold during such time interval, element 51 triggers a reversal actuator 53 which, in turn, actuates the flow reversal means 15 and controls the reversal cycle. The foregoing functional elements of the jam sensing means may be provided by discrete components or by components which combine functions, as will be further described herinafter.

Electrical Control Circuit

An electrical circuit energizes the three-phase electric drive motor 16 and controls the various functions of the shredder. The portion (not shown) of the circuitry dedicated to energizing drive motor 16 is substantially identical with that disclosed in my copending application, U.S. Ser. No. 378,616, filed May 17, 1982, now U.S. Pat. No. 4,560,110, for CURRENT DRAW-ACTUATED HYDRAULIC DRIVE ARRANGEMENT FOR ROTARY SHREDDER, FIG. 3, lines A through E thereof. The description of operation of this subcircuit is incorporated by reference herein. The control portion of the circuit (FIGS. 4 and 5) of the present invention is next described in two examples.

The circuit of the first example, shown in FIG. 4, uses discrete components including a pneumatic timer, contact relays, and a jam sensing device which includes the rotation sensor 18 and measuring circuitry which combines the functions of RPM monitor 52 and discriminator 51. Such a device is the Model R100SP Rotector Speed Switch manufactured by Electro-Sensors, Inc., of Minneapolis, Minn. This device includes a resistor-capacitor (R-C) circuit which filters the signal from sensor 18 to produce a voltage level which varies with average rotation speed. This level is applied to a silicon-controlled rectifier which controls an output relay switch 50 which is activated upon detection of a stoppage or slowing of a monitored shaft. The resistor in the R-C circuit is adjustable to set the speed threshold at which switch 50 is activated. The values of the capacitors can be altered to set the time interval over which the signal from sensor 18 is averaged to avoid activating switch 50 whenever the shaft rotation briefly slows during shredding. Switch 50 triggers a timer-relay circuit, further described hereinafter, which provides the reversal actuator function.

The second example, shown in FIG. 5, comprises a digital logic circuit designed to receive output pulses from the rotation sensor 18 and carry out the functions of all three elements 51, 52 53. Using integrated digital logic circuitry enables the jam-sensing and reversing control functions to be accomplished reliably and with much less costly components than in the first example.

EXAMPLE 1

With reference to FIG. 4, the electrical control circuit of this example includes a 120 VAC power source (not shown) applied to electrical conductors 40 and 42. This voltage is derived from the supply voltage source (not shown) of electric motor 16. The control circuit includes numerous subcircuits of conventional design, two of which are shown: pump motor power-on subcircuit 44 (line A) and shredder drive power-on subcircuit 46 (line C). Other conventional circuits (not shown), for performing "housekeeping" functions, are disclosed in my copending application and are incorporated by reference herein.

The control circuit also includes a start-up delay subcircuit 48 (line D) and a reversing control subcircuit (lines E, F, G, H, I, and J). The latter subcircuit includes RPM monitor switch contacts 50 (line F) of RPM monitor 52 (line E), reversal time delay means conductor 54 (line G), reverse valve solenoid conductor 56 (line H), and forward valve solenoid conductor 58 (line J).

Pump motor control subcircuit 44 (line A) includes a momentary start switch 60 for starting electric motor 16. Depressing this switch energizes a pump motor starter 62 and closes contacts 65 (line B). Contacts 64 electrically connect starter 62 to the 120 VAC applied to conductors 40 and 42, thereby sustaining hydraulic pump motor 16 operation after momentary switch 60 returns to its normal position. Electric motor 16 runs in one direction and continues until motor stop switch 66 is depressed.

A momentary start switch 68 (line C) enables the shredder drive. Depressing switch 68 energizes relay 70, thereby closing contacts 72 in subcircuit 48 (line D) to maintain the 120 VAC control voltage to shredder drive subcircuit 48 until momentary stop switch 74 is depressed.

Subcircuit 48 includes a start-up delay timer 76. Whenever the shredder drive is enabled, delay timer 76 is actiated to open contacts 78 in subcircuit 80 (line E) to disable RPM monitor 52 for the delay time interval preset therein. That time interval allows the cutter shafts to reach a speed of rotation above that set in RPM monitor 52 as a minimum threshold which would correspond to a jamming condition and thereby trigger a reversal. By "locking out" RPM monitor 52, delay timer 76 effectively disables the reversing control means during start-up of the shredder. When the time interval of timer 76 expires, contacts 78 re-close, thereby re-enabling RPM monitor 52.

During normal shredding operation, the following conditions exist. Relay contacts 78 (line E) remain closed to enable RPM monitor 52. Rotation sensor 18 detects shaft rotation and produces a pulse train signal having a repetition rate corresponding to shaft speed. RPM monitor 52 receives the signal and measures the shaft speed.

RPM monitor 52 includes an electrical switch (not shown) which automatically trips whenever the measured shaft speed drops below a predetermined minimum speed threshold. This switch closes contacts 50 (line F) to commence a reversal cycle in the reversing subcircuits F, G, H, I, and J, as will be hereinafter described.

As long as contacts 50 remain open, delay timer 82 (line F) and reversal timer 84 (line G) are deactivated. With reversal timer 84 deactivated, normally open contacts 86 (line H) remain open, keeping reverse valve solenoid 29 in a de-energized state, and normally closed contacts 88 (line J) remain closed, energizing forward valve solenoid 28 to sustain shredding.

Upon a substantial slowing of cutter shafts 8, a corresponding reduction in shaft speed is transmitted to the shafts of both hydraulic motor 14 and electric motor 16. Rotation sensor 18 located at either shaft detects the slowing of rotation and produces a correspondingly lower frequency pulse train signal. Receiving this signal, RPM monitor 52 measures the shaft speed and closes contacts 50 (line F) upon detection of a shaft speed below the predetermined threshold. Closure of contacts 50 applies 120 VAC power to delay timer 82.

Delay timer 82 delays the response of the reversing subcircuit to the closure of RPM monitor contacts 50 for a predetermined length of time, for example, 0.5 second, from the detection of a substantial slowing of rotation. It thus functions as a discriminator means for determining whether the slowing of shaft rotation was caused by a momentary or true jamming condition. If, during the delay interval to timer 82, the shaft speed has increased above the minimum threshold, thereby indicating that normal shredding has resumed following a stall or momentary interruption, RPM monitor contacts 50 re-open. Whenever this occurs, delay timer 82 simply "times out" without affecting the reversing subcircuit or shredding operation.

Whenever RPM monitor contacts 50 remain closed following the expiration of the time interval in delay timer 82, the jamming condition persists and the timer initiates reversal sequence by closing switch contact 90 (line G), which is in series with pneumatic delay reversal timer 84, upon detection of a jamming condition within the shredder. Closure of switch contact 90 energizes reversal timer 84 (line G), which is preferably a relay device having two sets of complementary acting contacts 86 and 88. Contacts 86 are normally open and are included in subcircuit 56 while contacts 88 are normally closed and are included in subcircuit 58. Reversal timer 84, therefore, is operatively connected to both reverse valve solenoid 29 in subcircuit 56 and forward valve solenoid 28 in subcircuit 58. As long as switch contact 90 remains open, contacts 88 remain closed, forward valve solenoid 28 is energized and reverse valve solenoid 29 is de-energized. The solenoids thus hold valve 26 in a forward flow position for running motor 14 in a forward direction for shredding. When reversal timer 84 is activated by the closure of switch contact 90, forward valve solenoid 28 is de-energized and reverse valve solenoid 29 is energized for the predetermined length of time preset into reversal timer 84, for example, 2–3 seconds. The flow-reversing valve is thus shifted to a reverse flow position for that period of time and then automatically returned to the forward flow position to reverse briefly the shredder and thereby clear the jamming condition.

During reversal, relay 92 (line I) is energized, thereby opening normally closed contacts 94 (line D) to disable start-up delay timer 76, which in turn disables RPM monitor 52 (line E) by opening contacts 78. With RPM monitor 52 disabled during reversal, RPM monitor contacts 50 open to withdraw electric power from the pneumatic reversal timer 84. Having been previously enabled, However, a pneumatic timer allows the reversing sequence to proceed irrespective of whether electric power is applied to the device. By "locking out" RPM monitor 52 while timer 84 remains operational, relay 92 effectively disables only the jam sensing means during reversal of the shredder.

Relay 92 can be eliminated if the shaft of electric motor 16 is monitored. This is so because electric motor 16 rotates only in one direction at all times, thereby eliminating a need for locking out RPM monitor 52 during a reversal. Delay timer 82 and its contacts 90 can also be eliminated, so that reversal timer 84 is controlled directly by contacts 50. The hydraulic drive 6, including relief valve 31, and the momentum of the electric motor, dampen the effects of most momentary jams so that they do not slow the electric motor shaft as much as a true jamming condition does. In that case the hydraulic drive and electric motor themselves function as a discriminator means, rendering the delay time 82 unnecessary. As discussed previously, monitoring the electric motor shaft necessitates the use of a wideband rotation sensor.

Operation of Automatic Reversing Controls

In operation, electric motor 16 drives pump 10 continuously in one direction to deliver pressure fluid through circuit 12 to valve 26. At start-up, valve 26 is spring-centered to its neutral position and the fluid passes through the open center of the valve back to tank 19 via line 24. The shredder drive is actuated by pushing button 68 (line C), causing the normally open relay contact 72 (line D) of relay 70 to close. Closing contact 72 applies 120 VAC through normally closed relay contact 94 to actuate delay timer 76. After the delay preset in timer 76 has expired, such timer closes relay contact 78 to energize forward solenoid 28 in subcircuit 58 (line J), thereby shifting valve 26 to its forward position. Reverse valve solenoid 29 in subcircuit 56 remains de-energized because the reversal time delay contacts 86 (line H) remain open. High pressure hydraulic fluid is thus directed through line 20 to hydraulic motor 14 to drive the cutter shafts in their forward directions for shredding material.

Material is then fed into the shredder for shredding in a shearing action between coacting cutter discs mounted on the counterrotating shafts 8. The material resists the torque of the cutter shafts. This load resistance causes the fluid pressure in line 20 of the hydraulic circuit to rise, for example, to an operating pressure of about 2500 psi.

Intermittently, as the cutters encounter tougher or greater amounts of material, resistance increases, slowing or stopping rotation of the cutter shafts and causing fluid pressure to rise to the setting of relief valve 31 (FIG. 2). If the cutters then break through the material, the pressure drops, forming pressure spikes. If a true jamming condition occurs, the fluid pressure increases to the setting of the relief valve and remains at a plateau.

In the aforementioned Culbertson, et al. and Cunningham, et al. designs, any pressure spikes exceeding a threshold, for example, 3200 psi, would actuate an electrical pressure switch in the fluid circuit, initiating a reversal cycle even though a true jamming condition had not occurred. However, they do not do so in the present invention. Rather than a pressure switch in the fluid circuit, the present invention utilizes the aforementioned rotation sensor 18 proximate the shaft of either the hydraulic motor or the electric motor, apart from the fluid circuit. The relay contacts 50 of RPM monitor 52 are set to trip at a shaft speed threshold, just below the shaft speed characterizing a true jamming condition.

When the RPM monitor circuitry in device 52 detects a shaft speed below the predetermined threshold level corresponding to a true jamming condition, it transmits a signal to actuate relay switch means 29. As mentioned above, electrical reversing control means 17 may include delay timer 82, which delays the closure of switch contact 90 until a first time delay interval, for example, 0.5 seconds, has elapsed. Whenever the stoppage or low shaft speed persists beyond the first time delay interval, switch contact 90 closes to actuate the flow-reversing circuit. This delay action technique serves as an electrical discriminator for distinguishing spurious response by RPM monitor 52 to reduced shaft speed and momentary interruptions in shredding caused by the introduction of especially difficult to shred objects, from a jamming condition requiring reversal of the cutting mechanism.

Closing switch contact 90 activates the reversing time delay relay 84 in subcircuit 54, to actuate, flow reversal in hydraulic circuit 12 in FIG. 1. Energizing time delay relay 84 simultaneously opens relay contacts 88 in subcircuit 58, thereby de-energizing forward solenoid valve 28, and closes relay contacts 86 in subcircuit 56, thereby energizing reverse valve solenoid 29. Solenoid 29 shifts flow-reversing valve 26 to the reverse position for reversing the fluid flow to motor 14, thereby reversing such motor. Reversal of motor 14 reverses the counterrotation of the cutter shafts, disgorging material upwardly from between such shafts to relieve the jamming condition. Once the monitored shaft speed returns to a value sufficient to deactivate RPM monitor 52, thereby causing relay contacts 50 to reopen, time delay relay 84 is de-energized but continues timing.

After a predetermined time period determined by the time delay setting of relay 84, relay contacts 86 reopen and relay contacts 88 reclose, thereby de-energizing reverse valve solenoid 29 and re-energizing forward valve solenoid 28. Valve 26 again directs high pressure fluid from pump 10 through line 20 of hydraulic circuit 12 to cause drive motor 14 to resume rotating in the forward direction to drive the cutter shafts in their shredding directions.

If, after reversal, the speed of shaft rotation as detected by RPM monitor 52 again decreases below the threshold level, the foregoing reversal cycle is repeated and continues so long as the true jamming conditions persist.

If the rotation sensor is positioned at the electric motor shaft, abrupt changes in cutter shaft speed are attenuated, as they are transmitted through the hydraulic drive, by the action of the relief valve 31 bleeding fluid back to tank 19. The high rotational momentum and electrical inductance of the electric motor further dampens such changes. As a result, momentary jamming conditions seldom slow the electric motor shaft sufficiently to initiate a reversal cycle.

The fluid circuit, drive train, and RPM monitor thereby cooperate to filter out momentary jamming conditions. Hydraulic pressure switches and fluid accumulators become unnecessary. Delay timer 82 can be omitted as well. The relief valve can be set to lower pressures than in prior systems, without interfering with refersal. On the contrary, doing so improves the spike filtering ability of the hydraulic circuit. As an added benefit, it reduces the peak pressures in the hydraulic fluid circuit, reducing the risks of seal failures and hydraulic component damage.

EXAMPLE 2

The electrical control circuit of this example includes integrated circuit digital logic components interconnected to accomplish the same reversing control functions described in Example 1. The use of digital logic components, however, costs substantially less, reduces electric power consumption, and provides both a compact and lightweight control module. The arrangement and operation of this circuit is best understood by reference to both FIGS. 5 and 6 throughout the following description. In this example, the shaft of hydraulic motor 14 is the monitored shaft.

The circuit of Example 2 includes electric motor starting circuitry and a 120 VAC power source (not shown) as described in Example 1 for use in producing a DC supply voltage suitable for the particular integrated circuit logic family chosen. The CMOS family of integrated circuits, which possess superior noise immunity properties, is considered best suited for application to this invention. In that case, a +15 VDC power supply (not shown) is used to power the control circuit. The circuit of Example 2 also uses a motor pump-on subcircuit identical with that described in Example 1 and may include the "housekeeping" subcircuits referenced therein.

Referring to FIG. 5, the reversing control subcircuit includes a retriggerable monostable multivibrator 96, which controls a buffer amplifier (not shown) on output line 132 to drive forward solenoid 28; timer 98, which controls a second buffer amplifier (not shown) on output line 140 to drive reverse solenoid 29; and J-K flip-flop 100, which produces a "kick start" pulse to re-start shredder operation after a reversal sequence has been completed.

In operation, electric motor 16 is started in the manner described in Example 1. When the logic device supply voltage (+V) is initially applied, the subcircuit comprising resistor 102 in series with capacitor 104 produces a short negative-going pulse (having duration equal to the product of the values of the resistance times the capacitance) at their juncture 103, which is connected to one input of each AND gate 106, 108, and 110. These gates in turn transmit this pulse to the $\overline{CL}$ inputs 112, 114, 116 of monostable multivibrator 96, timer 98, and flip-flop 100, respectively. This pulse is generated only at logic device power-on to produce a logic 0 state (i.e. "clear") at the Q output of each of logic devices 96, 98, 100. At this point, neither solenoid 28, 29 is energized so the shredder drive is off. The starting logic state of each device is shown at the left most end of lines D, E, and G of the timing diagram of FIG. 6.

The shredder drive is enabled by depressing momentary start switch 118. Connected to switch 118 are cross-coupled NAND gates 120, 122 to eliminate switch bounce. The output of NAND gate 122 is coupled to clock pulse input 124 of monostable multivibrator 96 through OR gate 126 to initiate shredder operation as will be described below. Also applied to inputs of OR gate 126, and therefore coupled to input 124 of multivibrator 96, are outputs 125 and 144 of rotation sensor 18 and flip-flop 100, respectively.

Monostable multivibrator 96 is retriggerable and produces a logic 1 state output pulse having a duration $T_1$ at output 132 (Q output) upon the occurrence of the leading edge of each pulse applied at its input 124. The pulse duration is set by variable resistor 128 and capacitor 130, for example, to 0.5 second, and may be adjusted by changing the value of resistor 128. Therefore, successive pulses occurring within a time interval less than 0.5 second continually retrigger multivibrator 96 and sustain a logic 1 state at output 132.

During normal shredding, rotation sensor 18 produces a stream of pulses to retrigger multivibrator 96. Its output 132 controls the operation of forward valve solenoid 28 to hold the flow-reversing valve 26 in the forward position.

Shredder operation commences when monostable multivibrator 96 receives the shredder drive pulse (FIG. 6, line A) activated by switch 118 at input 124. In response to the pulse, output 132 of multivibrator 96 switches to a logic 1 state to energize forward valve solenoid 28 and start cutter shaft rotation. Upon the start of shaft rotation, pulses produced by rotation sensor 18 delivered to the input 124 of multivibrator 96 through OR gate 126 retrigger the device to sustain a shredding operation. To successfully sustain shredding immediately after start-up, a pulse from rotation sensor 18 must trigger the input to monostable multivibrator 96 before the 0.5 second period ($T_1$) expires. For a rotation detector having 8 magnetic elements, this corresponds to a minimum required shaft rotation of 45° within 0.5 second after start-up. A 0.5 second interval is sufficient to start a shredder under a no load condition within the cutter shafts. Where both pump 10 and motor 14 are fixed displacement devices, the motor shaft attains operating speed more quickly than if a bidirectional pump is used, so interval $T_1$ can be shortened slightly, if desired.

With reference to FIG. 6, line B shows a representative sequence of events occurring during shredding. These events are shown to correspond with the state of output 132 of monostable multivibrator 96, the timing diagram of which is repeated for clarity in line D. As shown in line C, the pulses produced by rotation sensor 18 are more closely spaced (i.e., increasing in frequency) as the monitored shaft reaches operating speed. Thus, during the SHRED 1 interval of line B, forward valve solenoid 28 remains energized (line D) while reverse valve solenoid 29 is de-energized (line E) as describe below.

With reference to FIG. 5, reverse valve solenoid 29 is controlled by timer 98 which, when triggered, produces an output pulse having a 2–3 second duration $T_2$ set by resistor 134 and capacitor 136. This time interval controls the duration of reversal of the cutter shafts when a true jam exists. Timer 98 is triggered by the leading edge of a pulse produced at output 138 ($\overline{Q}$ output) of monostable multivibrator 96, which thereby signals a jam condition. Until such event occurs, output 140 (Q output) of timer 98 remains at logic 0 so that reverse solenoid 29 remains de-energized during normal shredding.

With reference to FIG. 6, line B, a STALL (momentary jam) condition exists whenever the shaft rotation slows substantially or stops temporarily. Under these conditions, monostable multivibrator 96 serves as the discriminator by continuing to enable forward shredder operation as long as two consecutive rotation sensor pulses occur within 0.5 second of each other, i.e. $t<T_1$. As shown in FIG. 6, lines B, D, and E, the shredding operation proceeds without a reversal operation.

Whenever two consecutive pulses do not occur within 0.5 seconds, i.e. $t>T_1$, corresponding to a stoppage or shaft rotation of less than 45° during that time, a jamming condition is considered to exist, as shown in line B.

With reference to FIGS. 5 and 6, immediately upon expiration of the 0.5 second delay, the following events occur. The monostable multivibrator 96 output 132 returns to logic 0, thereby de-energizing forward valve solenoid 28; and its output 138 ($\overline{Q}$ output) produces a leading edge to trigger timer 98, which produces a pulse $T_2$ of 2–3 second duration, thereby energizing reverse valve solenoid 29. In FIG. 6, time lines D and E show these transitions as corresponding to the REVERSE 1 event of line B.

During reversal, shaft rotation detected by rotation sensor 18 causes a signal to be applied to input 124 of monostable multivibrator 96. To prevent production of a signal at output 132 which would drive simultaneously forward valve solenoid 28 during reversal, output 142 ($\overline{Q}$ output) of timer 98 is connected through AND gate 106 to the $\overline{CL}$ input of monostable multivibrator 96. The output 142 forces multivibrator 96 to remain cleared and thereby locks out the trigger pulse presented at its input 124. Upon completion of reversal, this clear signal is removed.

At the completion of reversal, the operation of flip-flop 100 becomes important. Flip-flop 100 is triggered by a positive-going edge from output 142 of timer 98 and is wired to produce a logic state 1 at its output 144 (Q output) only upon such an event. Such occurs only after the reversal time delay $T_2$ has expired. Upon completion of a reversing sequence, flip-flop 100 produces a logic 1 signal at its output 144 which passes through OR gate 126 and triggers monostable multivibrator 96. This signal, shown in FIG. 6, line G, serves as a means to "kick start" (i.e. re-start) forward shredder rotation after reversal. Output 144 of flip-flop 100 is fed back to its $\overline{CL}$ input 116 through OR gate 126, differentiator circuit 146, and AND gate 110. This arrangement provides a narrow pulse to multivibrator 96 so as not to inhibit its response to rotation sensor 18 upon resumption of shredding.

Circuit 146 includes inverter 148, capacitor 150, resistor 152, and diode 154 to form a buffered differentiator circuit having an output pulse of sufficient width only to clear flip-flop 100 and thereby avoid inhibiting the operation of monostable multivibrator 96. Circuit 146 also clears flip-flop 100 after each rotation sensor pulse is detected (FIG. 6, line F). Continual clearing of flip-flop 100 simplifies the design but is not otherwise necessary for proper circuit operation.

Continuing along line B in FIG. 6, after the REVERSE 1 event, a jamming condition persists. The circuit in this example responds by attempting to resume forward shredding for $T_1=0.5$ second. If no appreciable shaft rotation is detected by rotation sensor 18, a second reversal sequence (REVERSE 2 in FIG. 6, line B) takes place in the manner described hereinabove. Following the second reversal sequence, a second "kick start" pulse (FIG. 6, line G) is applied to input 124 of monostable multivibrator 96 and normal shredding resumes (SHRED 3 in FIG. 6, line B).

A shredder drive stop switch 160, connected through cross-coupled NAND gates 156 and 158 to eliminate switch bounce, clears both monostable multivibrator 96 and timer 98, thereby de-energizing forward valve solenoid 28 and reverse valve solenoid 29, respectively. The circuit of FIG. 6 can alternatively be used to monitor rotation speed at the shaft of the electric pump motor 16. Because its shaft rotates faster than the shaft of motor 14, a conventional divider circuit (not shown) would be added in conductor 125 to reduce the frequency from the rotation sensor in proportion to the relative speeds of such motors. This result can be obtained in part by reducing the number of elements 36 in the sensor 18 (FIG. 3). Also, time interval $T_1$ can be adjusted to properly discriminate between true and momentary jamming conditions as sensed at motor 16.

Having described and illustrated the principles of my invention in a preferred embodiment, it should be apparent that it may be modified in arrangement and detail without departing from such principles. I claim all modifications coming within the scope and spirit of the following claims.

I claim:

1. A drive arrangement for a rotary shear-type shredder including shredding means, said arrangement comprising:

a hydraulic fluid-pumping means;

a first rotational drive means operatively connected to said fluid-pumping means for undirectionally driving the latter;

a reversible hydraulic motor means;

a second rotational drive means operatively-connected to said hydraulic motor means for bidirectionally driving said shredding means;

a hydraulic fluid drive circuit means including the hydraulic fluid-pumping means and the reversible hydraulic motor means for transmitting power from the first drive means in a downstream direction to the second drive means and transmitting changes in a load in the shredder means upstream to the first drive means, the first drive means being responsive to an increase in load to operate at a reduced speed;

a flow-reversing means for reversing a fluid flow in the hydraulic circuit to the hydraulic motor means to reverse said motor means and thus said shredding means; and an electrically operable reversing control means for actuating the flow-reversing means upon detecting an increase in load corresponding to a jamming condition during shredding operation, including:

jam-sensing means connected to the first drive means upstream of the fluid circuit means and operable to sense the speed of said first drive means and responsive to a predetermined minimum speed thereof corresponding to a jamming condition in the shredding means to produce an electrical signal; and electrically reversal operable actuation means responsive to the reversal signal for actuating the flow-reversing means to reverse flow in the fluid circuit means for a predetermined time interval.

2. A drive arrangement according to claim 1 including filtering means cooperable with said jam-sensing means for filtering out transitory changes in speed of the second drive means due to momentary jamming conditions in the shredding means and thereby aiding the jam-sensing means in discriminating between momentary and true jamming conditions so as to avoid producing reversal signals in response to momentary jamming conditions.

3. A drive arrangement according to claim 2 including electrical means in the jam-sensing means for measuring average speed of the sensed drive means within a discrete time interval and producing a reversal signal only when the average speed is reduced to said minimum speed.

4. A drive arrangement according to claim 2 in which the filtering means comprises means in said fluid circuit for damping transmission of an instantaneous increase in load due to a momentary jamming condition of the shredding means to the jam sensor means.

5. A drive arrangement according to claim 4 in which the filtering means includes a pressure relief valve in the hydraulic fluid circuit set at a low enough pressure to relieve fluid pressure spikes due to momentary jamming conditions so as to minimize their effect on rotational speed of the pump driving means but at a pressure above a fluid pressure prevailing during normal shredding.

6. A drive arrangement according to claim 2 in which the first drive means comprises rotational pump driving means having a rotational inertia sufficient to dampen changes in rotational speed thereof due to transitory changes of shredder load so that the rotational speed of the pump driving means exceeds said minimum speed except in case of true jamming conditions.

7. A drive arrangement for a rotary shear-type shredder including shredding means, said arrangement comprising:

a hydraulic fluid-pumping means;

a first rotational drive means operatively connected to said fluid-pumping means for driving the latter;

a reversible hydraulic motor means;

a second rotational drive means including a rotational drive train element operatively connected to said hydraulic motor means for bidirectionally driving said shredding means;

a hydraulic fluid drive circuit including the hydraulic fluid-pumping means and the reversible hydraulic motor means;

a flow-reversing means to reverse a fluid flow in the hydraulic circuit to the hydraulic motor means to reverse said motor means and thus said shredding means; and an electrically operable reversing control means for actuating the flow-reversing means upon detecting a jamming condition during a shredding operation, including:

jam-sensing means including a rotation sensor for sensing the rotational speed of the drive train element of the second drive means and responsive to a predetermined minimum speed thereof corresponding to a jamming condition to produce an electrical reversal signal;

electrically operable actuation means responsive to the reversal signal for actuating the flow-reversing means to reverse flow in the fluid circuit to reverse the shredding means for a predetermined time interval and then actuating the flow-reversing means to cause the shredding means to resume shredding in a forward direction; and lock-out means for disabling the jam-sensing means during reversal of the shredder.

8. A drive arrangement according to claim 7 including lock-out means for disabling the jam-sensing means during start-up of the shredding means.

* * * * *

UNITED STATES PATENT AND TRADEMARK OFFICE

CERTIFICATE OF CORRECTION

PATENT NO. : 4,793,561

DATED : December 27, 1988

INVENTOR(S) : Dan S. Burda

It is certified that error appears in the above-identified patent and that said Letters Patent is hereby corrected as shown below:

In the Specification:

Column 1, line 51, after "ployed" insert --hydraulic--.

Column 2, line 34, "minimal" should be --Minimal--.

Column 6, line 21, "enregize" should be --energize--.

Column 8, line 25, "65" should be --64--.

Column 8, line 40, "actiated" should be --activated--.

Column 9, line 65, "However" should be --however--.

Column 13, line 14, "the" should be --this--.

In the Claims:

Claim 1, column 15, line 49, after "electrical" insert --reversal--.

Claim 1, column 15, line 51, delete "reversal".

Signed and Sealed this

Seventh Day of November, 1989

*Attest:*

JEFFREY M. SAMUELS

*Attesting Officer*

*Acting Commissioner of Patents and Trademarks*